US005092903A

United States Patent [19]

Niemann

[11] Patent Number: 5,092,903

[45] Date of Patent: Mar. 3, 1992

[54] PROCESS FOR DYEING OR PRINTING BLENDS OF CELLULOSIC FIBRE MATERIALS AND SILK WITH DIHALO-PROPIONAMIDO OR HALO-ACRYL AMIDO REACTIVE DYES

[75] Inventor: Friedhelm Niemann, Friedrichsdorf, Fed. Rep. of Germany

[73] Assignee: Ciba-Geigy Corporation, Ardsley, N.Y.

[21] Appl. No.: 584,814

[22] Filed: Sep. 18, 1990

[30] Foreign Application Priority Data

Sep. 22, 1989 [CH] Switzerland ..... 3445/89

[51] Int. Cl.[5] ..... D06P 3/82; D06P 1/38

[52] U.S. Cl. ..... 8/529; 8/543; 8/661; 8/662; 8/685; 8/687; 8/917; 8/918

[58] Field of Search ..... 8/543, 529

[56] References Cited

U.S. PATENT DOCUMENTS

| | | | |
|---|---|---|---|
| 4,444,564 | 4/1984 | Salathe et al. | 8/588 |
| 4,557,731 | 12/1985 | Sasakura et al. | 8/531 |
| 4,560,388 | 12/1985 | Rohrer | 8/543 |
| 4,568,350 | 2/1986 | Rohrer | 8/543 |
| 4,693,726 | 9/1987 | Meininger et al. | 8/547 |
| 4,908,436 | 3/1990 | Scheibli | 534/637 |
| 4,917,705 | 4/1990 | Mausezahl et al. | 8/549 |

FOREIGN PATENT DOCUMENTS

| | | |
|---|---|---|
| 112797 | 7/1984 | European Pat. Off. . |
| 785222 | 10/1957 | United Kingdom . |
| 875163 | 8/1961 | United Kingdom . |
| 1261031 | 1/1972 | United Kingdom . |
| 1278262 | 6/1972 | United Kingdom . |

*Primary Examiner*—A. Lionel Clingman
*Attorney, Agent, or Firm*—George R. Dohmann; Edward McC. Roberts

[57] ABSTRACT

The invention relates to a process for dyeing or printing blends of cellulosic fibre materials and silk with reactive dyes, which process comprises impregnating said blends with reactive dyes of formula $$D\left[\underset{\underset{R}{|}}{N}-CO-Y\right]_m, \qquad (1)$$

wherein D is the radical of a sulfonated dye of the monoazo, polyazo, metal complex azo, anthraquinone, phthalocyanine, formazan, azomethine, dioxazine, phenazine, stilbene, triphenylmethane, xanthene, thioxanthone, nitroaryl, naphthoquinone, pyrenequinone or perylenetetracarbimide series, R is hydrogen or unsubstituted or substituted $C_1$-$C_4$alkyl, Y is a radical $$-\underset{\underset{X}{|}}{CH}-CH_2-X \quad \text{or} \quad -\underset{\underset{X}{|}}{C}=CH_2,$$

m is 1 or 2 and X is chloro or bromo, subjecting the impregnated goods to an optional aftertreatment, and steaming the dyed goods to fix the dyes on the blend. Very good tone-in-tone dyeings and prints are obtained.

21 Claims, No Drawings

PROCESS FOR DYEING OR PRINTING BLENDS OF CELLULOSIC FIBRE MATERIALS AND SILK WITH DIHALO-PROPIONAMIDO OR HALO-ACRYL AMIDO REACTIVE DYES

The present invention relates to a novel process for dyeing or printing blends of cellulosic fibre materials and silk with reactive dyes by impregnating said blends with reactive dyes and subsequently steaming the dyeings so obtained.

Reactive dyes have long been widely used for dyeing and printing textiles made from fibre materials. However, in view of the increasing demands being made of dyeings obtained with reactive dyes in respect of economy, application technology and fastness properties, the current state of the art is in many respects unsatisfactory. In recent years, efforts have also been made to optimise dyeing processes, both as regards the choice of dyes and the dyeing process. To obtain satisfactory and reproducible results, the dyer must rely on dyeing processes which are characterised by the following criteria: the simplest possible mode of operation, good build-up of the dye on the fibre and complete fixation. A problem of particular interest concerns dyeing fibre blends, especially blends of cellulosic fibre materials and silk, such as viscose/silk or cotton-silk blends. The problem that arises when dyeing these blends is the tone-in-tone dyeing of both fibre materials. So far the problem has been dealt with by subjecting blends of cellulosic fibre materials and silk to two different dyeing processes, i.e. dyeing with dyes for the one type of fibre followed by an aftertreatment, and then dyeing with other dyes for the other type of fibre followed by an aftertreatment. Such a process consisting of two dyeing procedures is cost-intensive and time-consuming.

Surprisingly, the process of this invention makes it possible to dye or print blends of cellulosic fibre materials and silk with reactive dyes to obtain a good tone-in-tone dyeing of both types of fibre in the simplest manner without the drawbacks referred to above.

Specifically, the invention relates to a process for dyeing or printing blends of cellulosic fibre materials and silk with reactive dyes, which process comprises impregnating said blends with reactive dyes of formula $$D\left[\underset{\underset{R}{|}}{N}-CO-Y\right]_m, \qquad (1)$$

wherein D is the radical of a sulfonated dye of the monoazo, polyazo, metal complex azo, anthraquinone, phthalocyanine, formazan, azomethine, dioxazine, phenazine, stilbene, triphenylmethane, xanthene, thioxanthone, nitroaryl, naphthoquinone, pyrenequinone or perylenetetracarbimide series, R is hydrogen or unsubstituted or substituted $C_1$–$C_4$alkyl, Y is a radical $$-\underset{\underset{X}{|}}{CH}-CH_2-X \quad \text{or} \quad -\underset{\underset{X}{|}}{C}=CH_2,$$

m is 1 or 2 and X is chloro or bromo, subjecting the impregnated goods to an optional aftertreatment, and steaming the dyed goods to fix the dyes on the blend fabric.

Surprisingly, this process gives tone-in-tone dyeings or prints on this type of fibre blend.

The process of this invention is particularly suitable for dyeing fibre blends mentioned above.

The reactive dyes preferably used in process of this invention are:

a) reactive dyes of formula (1), wherein D is the radical of a mono- or disazo dye;

b) reactive dyes of formula (1), wherein D is the radical of a copper complex azo dye;

c) reactive dyes of formula (1), wherein D is the radical of a copper or nickel phthalocyanine, of a copper formazane complex or of a triphenyldioxazine;

d) reactive dyes according to b), wherein D is the radical of a 1:1 copper complex azo dye of the benzene or naphthalene series, the copper atom being attached in each case to a metallisable group in the ortho-position to the azo bond;

e) reactive dyes of formula (1) or according to a) to d), wherein R is hydrogen or unsubstituted $C_1$–$C_4$alkyl;

f) reactive dyes of formula $$[D_1-N=N-K]\left[\underset{\underset{R}{|}}{N}-CO-Y\right]_{1-2}, \qquad (2)$$

wherein $D_1$ is the radical of a diazo component of the benzene or naphthalene series, K is the radical of a coupling component of the benzene, naphthalene or heterocyclic series, for example of the pyridone or pyrazolone series, R is hydrogen or unsubstituted $C_1$–$C_4$alkyl, Y is as defined for formula (1), and the reactive radical is attached to the diazo component or to the coupling component, or one reactive radical is attached to both the diazo component and to the coupling component, or two reactive radicals are attached to the coupling component or to the diazo component;

g) reactive dyes of formula (1) according to a) to f), wherein R is hydrogen or methyl;

h) reactive dyes of formula (1) according to a) to g) which contain 2 radicals of formula $$-\underset{\underset{R}{|}}{N}-CO-Y \qquad (3)$$

i) reactive dyes of formula (1) or according to a) to h), wherein Y is an $\alpha,\beta$-dibromoethyl or $\alpha$-bromovinyl radical.

The radical D in formula (1) can be substituted in the usual manner and preferably contains one or more sulfonic acid groups.

Typical examples of further substituents at the radical D are: $C_1$–$C_4$alkyl groups such as methyl, ethyl, propyl, isopropyl and butyl; $C_1$–$C_4$alkoxy groups such as methoxy, ethoxy, propoxy, isopropoxy and butoxy; $C_1$–$C_6$alkanoylamino groups such as acetylamino and propionylamino, benzoylamino, amino, $C_1$–$C_4$alkylamino, phenylamino, $C_1$–$C_4$alkoxycarbonyl, nitro, cyano, trifluoromethyl, halogen such as fluoro, chloro and bromo, sulfamoyl, carbamoyl, ureido, carboxy, hydroxy, sulfomethyl and sulfo.

Substituents present in those reactive dyes, wherein D is the radical of an azo dye, are preferably methyl, ethyl, methoxy, ethoxy, benzoylamino, amino, acetylamino, ureido, sulfomethyl, hydroxy, carboxy, halogen or sulfo.

The radical of an unsubstituted or substituted $C_1$–$C_4$alkyl radical R may be a straight-chain or branched radical which can be further substituted, for example by halogen, hydroxy, aminosulfonyl, cyano, alkoxy, alkoxycarbonyl, carboxy, sulfato or sulfo, or an unsubstituted $C_1$–$C_4$alkyl radical.

Representative examples of R are: methyl, ethyl, propyl, isopropyl, butyl, isobutyl, sec-butyl, tert-butyl, carboxymethyl, β-carboxethyl, β-carboxypropyl, methoxycarbonylmethyl, ethoxycarbonylmethyl, β-methoxyethyl, β-ethoxyethyl, β-methoxypropyl, β-chloroethyl, γ-chloropropyl, γ-bromopropyl, β-hydroxyethyl, β-hydroxybutyl, β-cyanoethyl, sulfomethyl, β-sulfoethyl, aminosulfonylmethyl and β-sulfatoethyl. R is preferably an unsubstituted $C_1$–$C_4$alkyl radical, most preferably methyl.

A suitable radical Y is a α,β-dichloroethyl, α,β-dibromoethyl, α-chlorovinyl and α-bromovinyl radical.

The dyes of formula (1) contain at least one fibre-reactive radical of formula (3).

By fibre-reactive compounds are meant those compounds which are able to react with the hydroxyl groups of cellulose or with the amino groups of natural or synthetic polyamides to form covalent chemical bonds.

Reactive dyes which may be used in the process of this invention are known. They can be prepared by acylating a dye of formula

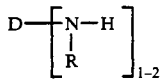

(4)

or a dye precursor, with at least one equivalent of an acyl halide of formula

Hal—CO—Y (5), wherein Hal is a halogen atom, and D, R and Y in formulae (4) and (5) are as defined for formula (1) and, if dyestuff precursors are used, converting these into the desired final dyes.

The process variant in which dyestuff precursors are used as starting materials is suitable for obtaining reactive dyes of the formula (1), wherein D is the radical of a dye consisting of two or more than two components. Examples of such dyes consisting of two or more components are monoazo, disazo, triazo, tetraazo, metal complex azo, formazan and azomethine dyes.

If the dye is e.g. an azo dye, it is possible to react a diazo component which, in addition to containing the amino group to be diazotised, contains an —N(R)H group, or a coupling component which contains an —N(R)H group, with an acyl halide of formula (5), and subsequently to convert the resultant product into the desired azo dye by coupling to the other component, and then to carry out a further optional conversion reaction.

By means of this process variant it is possible to prepare reactive dyes of formula (1) which contain two reactive radicals by using a diazo component and coupling component which each contain an —N(R)H group, and carrying out acylation before or after the coupling.

Dyes of formula (1) which contain two reactive radicals can also be prepared by using dyes of formula (4) which already contain a group of formula (3) in the radical D, or which contain two —N(R)H groups, and acylating them together. If the reactive dyes so prepared contain groups which are capable of metal complexing, then the reactive dyes can also subsequently be metallised.

The preferred starting materials are dyes of formula (4), wherein D is the radical of a mono- or disazo dye.

In principle, the reactive dyes of formula (1) of all dye classes can be prepared in a manner known per se, or by methods analogous to known ones, by starting from precursors or intermediates of dyes which contain fibre-reactive radicals of formula (3) or by introducing these fibre-reactive radicals into intermediates of dyestuff character which are suitable for this purpose.

The acylation of the dyes formula (4) or the dyestuff precursors with the acyl halides of formula (5) is carried out by methods which are known per se, preferably in aqueous solution or suspension and in the presence of alkaline acid acceptors, e.g. aqueous alkali metal hydroxides, carbonates or bicarbonates.

A further conversion reaction, which can be carried out immediately after the synthesis, comprises treating a reactive dye of formula (1), wherein the radical of formula (3) is an α,β-dibromopropionylamino radical, with a dehydrohalogenating agent such as sodium hydroxide, so that the α,β-dibromopropionyl group is converted into the α-bromoacryloyl group.

Possible starting materials which can be used for the preparation of the reactive dyes of formula (1) are listed individually below. Suitable amino dyes are, in particular, those dyes of the following structural formulae:

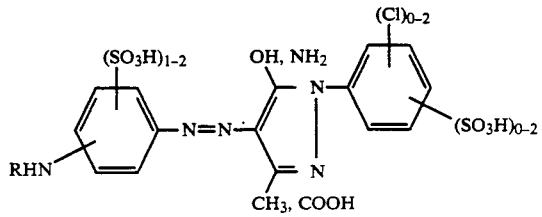

-continued
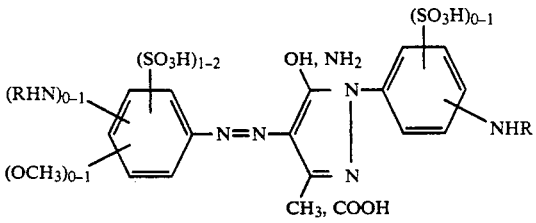
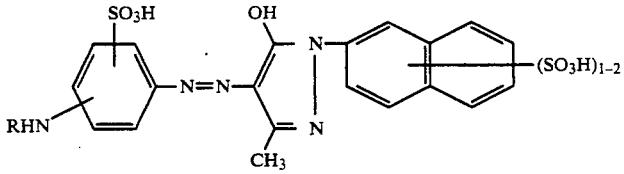
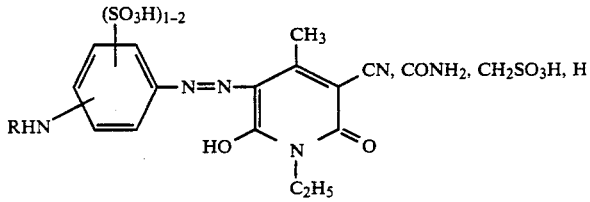
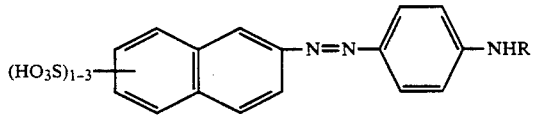
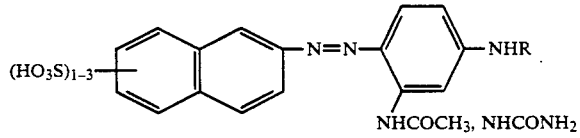
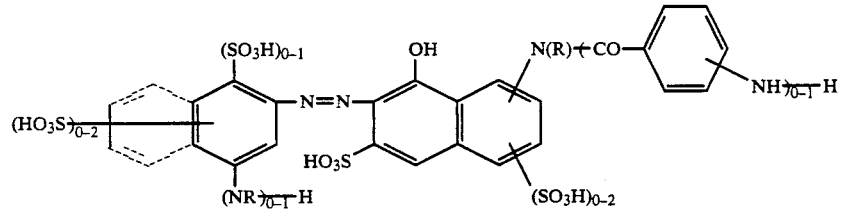
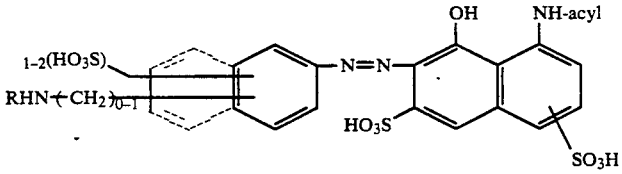
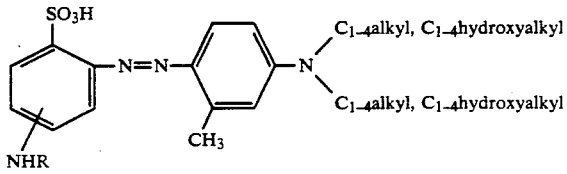

-continued
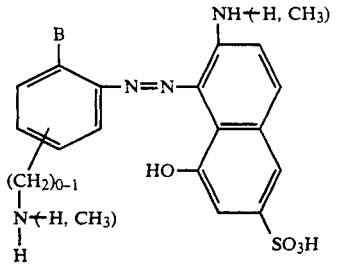
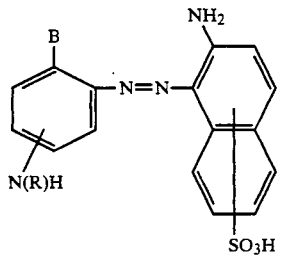
wherein acyl is, for example, acetyl or unsubstituted or substituted benzoyl and B is —$SO_3H$ or
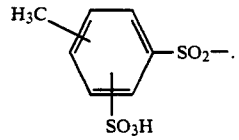
Metal complexes of dyes of formulae:
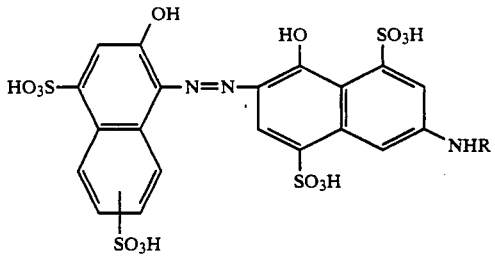
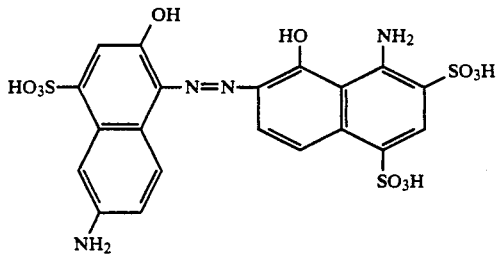
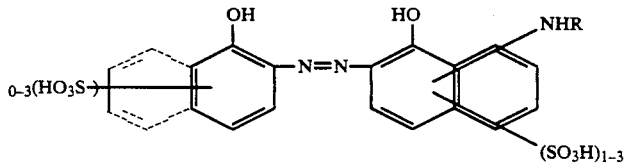

-continued

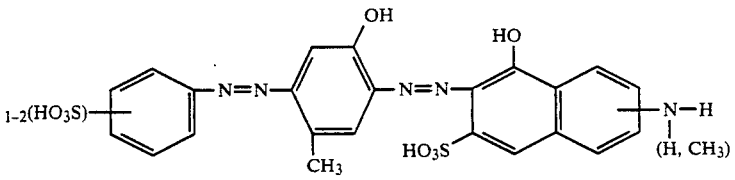

The preferred metal atom is Cu (1:1 complex) or Cr and Co (1:2 complex). Chromium and cobalts complexes may contain the azo compound of the above formula once or twice, i.e. they may have a symmetrical structure or an unsymmetrical structure with any other ligand group.

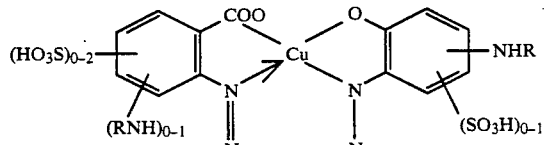

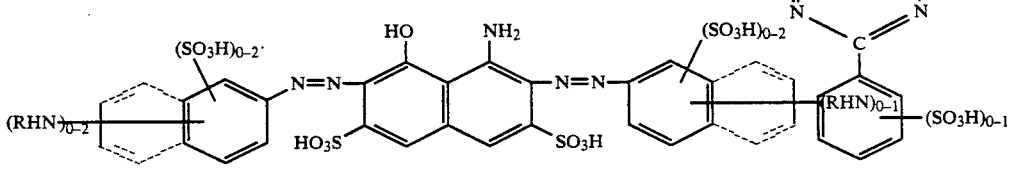

The condensed rings indicated by dotted lines denote possible alternative naphthalene systems

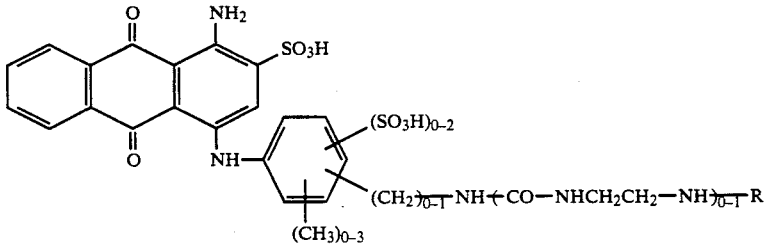

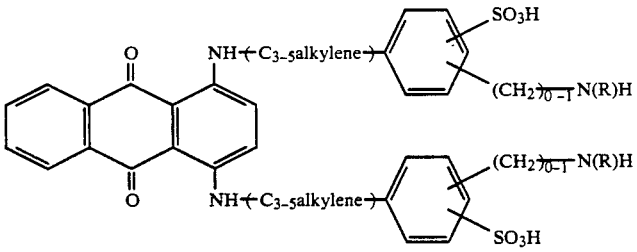

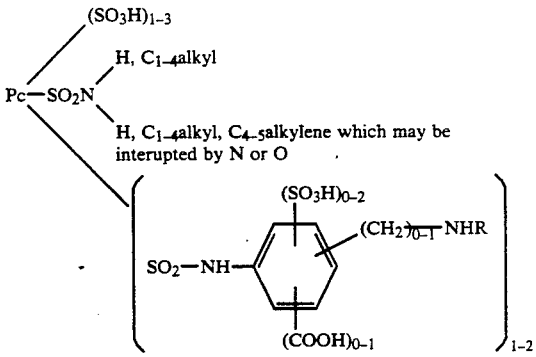

In the formula, Pc is the Cu- or Ni-phthalocyanine radical. The total number of substituents at the Pc nucleus is 4.

-continued

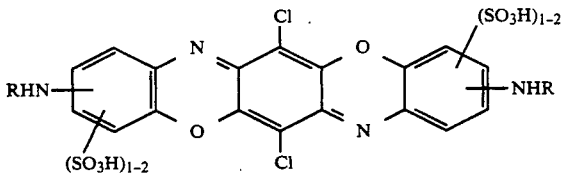

The dyes of the above formulae may be further substituted in the alkyl or aryl moieties, preferably by the substituents specified above in the definition of D in formula (1).

Particularly important azo dyes of formula (2) are the following:

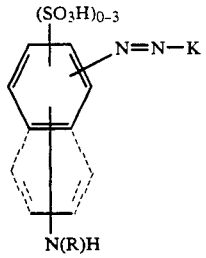

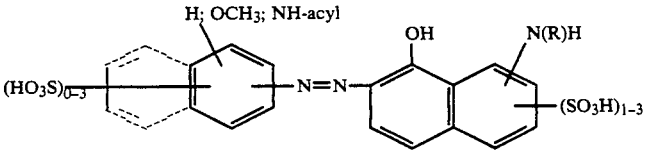

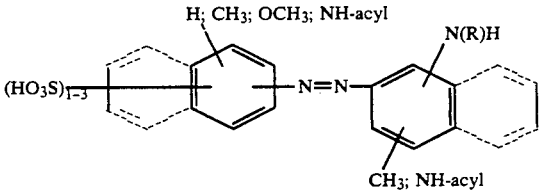

and

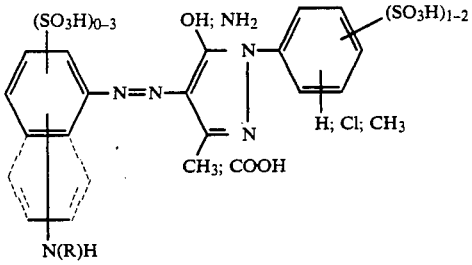

wherein K is the radical of a coupling component of the benzene, naphthalene or heterocyclic series, acyl is a low molecular aliphatic acyl radical containing not more than 3 carbon atoms or is an aromatic radical containing not more than 8 carbon atoms, and R is as defined for formula (2); as well as the metal complex azo dyes of formulae

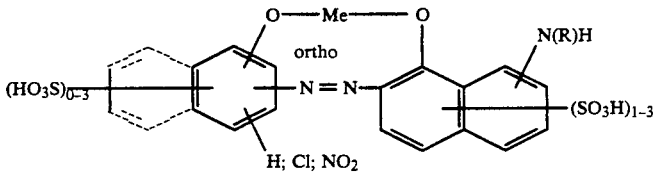

and

-continued

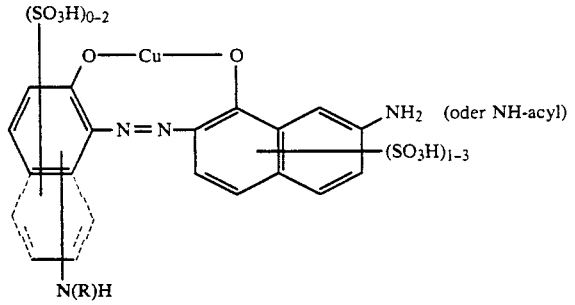

wherein R and acyl are as defined above and Me is Cu, Cr or Co.

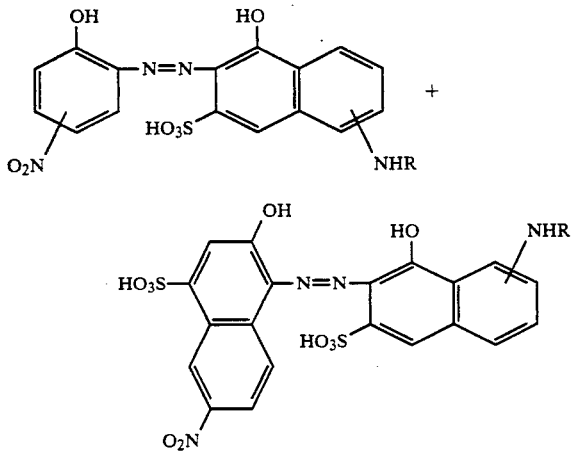

asymmetrical 1:2 chromium or 1:2 cobalt complex.

If the starting materials used for obtaining the preferred reactive dyes of formula (1), wherein D is the radical of an azo dye, are not final amino dyes, for example those described above, but dyestuff precursors, i.e. the diazo and coupling components, then said starting materials are typically:

Diazo components:

aminobenzene, 1-amino-2-, -3- or -4-methylbenzene, 1-amino-2-, -3- or -4-methoxybenzene, 1-amino-2-, -3- or -4-chlorobenzene, 1-amino-2,5-dichlorobenzene, 1-amino-2,5-dimethylbenzene, 1-amino-3-methyl-6-methoxybenzene, 1-amino-2-methoxy-4-nitrobenzene, 4-aminodiphenyl, 1-aminobenzene-2-, -3- or -4-carboxylic acid, 2-aminodiphenylether, 1-aminobenzene-2-, -3- or -4-sulfonamide, -N-methylamide, -N-ethylamide, -N,N-dimethylamide or -N,N-diethylamide, dehydrothio-p -toluidinesulfonic acid, 1-amino-3-trifluoromethylbenzene-6-sulfonic acid, 1-amino-3- or -4-nitrobenzene, 1-amino-3- or -4-acetylamino-benzene, 1-aminobenzene-2-, -3- or -4-sulfonic acid, 1-aminobenzene-2,4- and -2,5-disulfonic acid, 1-amino-4-methylbenzene-2-sulfonic acid, 1-amino-3-methylbenzene-6-sulfonic acid, 1-amino-6-methylbenzene-3- or -4-sulfonic acid, 1-amino-2-carboxybenzene-4-sulfonic acid, 1-amino-4-carboxybenzene-2-sulfonic acid, 1-amino-4- or -5-chlorobenzene-2-sulfonic acid, 1-amino-6-chlorobenzene-3- or -4-sulfonic acid, 1-amino-3,4-dichlorobenzene-6-sulfonic acid, 1-amino-2,5-dichlorobenzene-6-sulfonic acid, 1-amino-2,5-dichlorobenzene-4-sulfonic acid, 1-amino-4-methyl-5-chlorobenzene-2-sulfonic acid, 1-amino-5-methyl-4-chlorobenzene-2-sulfonic acid, 1-amino-4-or -5-methoxybenzene-2-sulfonic acid, 1-amino-6-methoxybenzene-3- or -4-sulfonic acid, 1-amino-6-ethoxybenzene-3- or -4-sulfonic acid, 1-amino -2,4-dimethoxybenzene-6-sulfonic acid, 1-amino-2,5-dimethoxybenzene-4-sulfonic acid, 1-amino-3-acetylaminobenzene-6-sulfonic acid, 1-amino-4-acetylaminobenzene-2-sulfonic acid, 1-amino-3-acetylamino-4-methylbenzene-6-sulfonic acid, 2-amino-1-methylbenzene-3,5-disulfonic acid, 1-amino-4-methoxybenzene-2,5-disulfonic acid, 1,3-diaminobenzene-4-sulfonic acid, 1,4-diaminobenzene-3-sulfonic acid, 1,4-diaminobenzene-3-sulfonic acid, 1,4-diaminobenzene-2,5-disulfonic acid, 1-amino-3- or -4-nitrobenzene-6-sulfonic acid, 1-aminonaphthalene, 2-aminonaphthalene, 1-aminonaphthalene-2-, -4-, -5-, -6-, -7- or -8-sulfonic acid, 2-aminonaphthalene-1-, -3-, -4-, -5-, -6-, -7- or -8-sulfonic acid, 1-aminonaphthalene-3,6- or -5,7-disulfonic acid, 2-aminonaphthalene-1,5-, -1,7-, -3,6-, -5,7-, -4,8 or -6,8-disulfonic acid 1-aminonaphthalene-2,5,7-trisulfonic acid, 2-aminonaphthalene-1,5,7-, 3,6,8- or -4,6,8-trisulfonic acid, 1-hydroxy-2-aminobenzene-4-sulfonic acid, 1-hydroxy-2-aminobenzene-5-sulfonic acid, 1-hydroxy-2-aminobenzene-4,6-disulfonic acid, 1-hydroxy-2-amino-4-acetylaminobenzene-6-sulfonic acid, 1-hydroxy-2-amino-6-acetylaminobenzene-4-sulfonic acid, 1-hydroxy-2-amino-4-chlorobenzene-5-sulfonic acid, 1-hydroxy-2-amino-4-methylsulfonyl benzene, 1-amino-2-hydroxy-6-nitronaphthalene-4-sulfonic acid, 2-amino-1-hydroxynaphthalene-4,8-disulfonic acid, 4-aminoazobenzene3,4'-disulfonic acid, 3-methoxy-4-amino-6-methylazobenzene-2',4'-disulfonic acid, 3-methoxy-4-amino-6-methylazobenzene-2',5'-disulfonic acid.

Coupling components:

phenol, 1-hydroxy-3- or -4-methylbenzene, 1-hydroxybenzene-4-sulfonic acid, 1-hydroxynaphthalene, 2-hydroxynaphthalene, 2-hydroxynaphthalene-6- or -7-sulfonic acid, 2-hydroxynapthalene-3,6- or -6,8-disulfonic acid, 1-hydroxynaphthalene-4-sulfonic acid, 1-hydroxynaphthalene-4,6- or -4,7-disulfonic acid, 1-amino-3-methylbenzene, 1-amino-2-methoxy-5-methylbenzene, 1-amino-2,5-dimethylbenzene, 3-aminophenylurea, 1-amino-3-acetylaminobenzene, 1-amino-3-hydroxyacetylaminobenzene, 1,3-diaminobenzene-4-sulfonic acid, 1-aminonaphthalene-6- or -8-sulfonic acid, 1-amino-2-methoxynaphthalene-6-sulfonic acid, 2-aminonaphthalene-5,7-disulfonic acid, -1-amino-8-hydroxynaphthalene-6-sulfonic acid, 1-amino-8-hydroxynaphthalene-2,4-disulfonic acid, 2-hydroxy-3-aminonaphthalene-5,7-disulfonic acid, 1-amino-8-hydroxynaphthalene-2,4,6-trisulfonic acid, 1-hydroxy-8-acetylaminonaphthalene-3-sulfonic acid, 1-benzoylamino-8-hydroxynaphthalene-3,6- or -4,6-disulfonic acid, 2-benzoylamino-5-hydroxynaphthalene-7-sulfonic acid, 2-amino-5-hydroxynaphthalene-7-sulfonic acid, 2-methyl- or 2-ethylamino-5-hydroxynaphthalene-7-sulfonic acid, 2-(N-acetyl-N-methylamino)-5-hydroxynaphthalene-7-sulfonic acid, 2-acetylamino-5-hydroxynaphthalene-7-sulfonic acid, 2-amino-5-hydroxynaphthalene-1,7-disulfonic acid, 2-amino-8-hydroxynaphthalene-6-sulfonic acid, 2-methyl- or -ethylamino-8-hydroxynaphthalene-6-sulfonic acid, 2-(N-acetyl-N-methylamino)-8-hydroxynaphthalene-6-sulfonic acid, 2-acetylamino-8-hydroxynaphthalene-6-sulfonic acid, 2-amino-8-hydroxynaphthalene-3,6-disulfonic acid, 2-acetylamino-8-hydroxynaphthalene-3,6-disulfonic acid, 1-amino-5-hydroxynaphthalene-7-sulfonic acid, 1-amino-8-hydroxynaphthalene-3,6- or -4,6-disulfonic acid, 1-acetylamino-8-hydroxynaphthalene-3,6- or -4,6-disulfonic acid, 1-(4'-aminobenzoylamino)-8-hydroxynaphthalene-3,6- or -4,6-disulfonic acid, 1-(3'-aminobenzoylamino)-8-hydroxynaphthalene-3,6- or -4,6-disulfonic acid, 1-(3'-nitrobenzoylamino)-8-hydroxynaphthalene-3,6- or -4,6-disulfonic acid, 2-(4'-sulfophenylamino)-5-hydroxynaphthalene-7-sulfo nic acid, 3-methylpyrazol-5-one, 1-phenyl-3-methylpyrazol-5-one, 1-(4'-sulfophenyl)-3-methylpyrazol-5-one, 1-(4'-sulfophenyl)-pyrazol-5-one-3-carboxylic acid, 1-(3'-aminophenyl)-3-methylpyrazol-5-one, 1-(2',5'-disulfophenyl)-3-methylpyrazol-5-one, 1-(2'-methyl-4'-sulfophenyl)-pyrazol-5-one-3-carboxylic acid, 1-(4',8'-disulfonaphthaly-[2']-3-methylpyrazol-5-one, 1-(5',7'-disulfonaphthyl-[2']-3-methylpyrazol-5-one, 1-(2',5'-dichloro-4'-sulfophenyl)-3-methylpyrazol-5-one, 3-aminocarbonyl-4-methyl-6-hydroxypyrid-2-one, 1-ethyl-3-cyano- or -3-chloro-4-methyl-6-hydroxypyrid-2-one, 1-ethyl-3-sulfomethyl-4-methyl-6-hydroxypyrid-2-one, 2,4,6-triamino-3-cyanopyridine, 2-(3'-sulfophenylamino)-4,6-diamino-3-cyanopyridine, 2-(2'-hydroxyethylamino)-3-cyano-4-methyl-6-aminopyridine, 2,6-bis-(2'-hydroxyethylamino)-3-cyano-4-methylpyridin, 1-ethyl-3-carbamoyl-4-methyl-6-hydroxypyrid-2-one, 1-ethyl-3-sulfomethyl-4-methyl-5-carbamoyl-6-hydroxypyrid-2-one, N-acetoacetylaminobenzene, 1-(N-acetoacetylamino)-2-methoxybenzene-5-sulfonic acid, 4-hydroxyquinol-2-one, 1-amino-8-hydroxy-2-(phenylazo)-naphthalene-3,6-disulfonic acid, 1-amino-8-hydroxy-2-(4'-sulfophenylazo)-naphthalene-3,6-disul fonic acid, 1-amino-8-hydroxy-2-(2',5'-disulfophenylazo)-naphthalene-3,6-disulfonic acid.

If dyestuff precursors are used as starting materials, at least one of the two components (diazo component or coupling component) must contain an acylatable amino group. The diazotisation of the intermediates which contain a diazotisable amino group is normally carried out by treatment with nitrous acid in an aqueous solution of mineral acid at low temperature, and the coupling is carried out at weakly acid, neutral or weakly alkaline pH values.

Suitable acylating agents which, in addition to the acylating site, also contain a reactive radical, are in particular the halides or anhydrides of organic acids which contain easily replaceable atoms or groups of atoms.

Mention may also be made of those reactive compounds which can also be obtained via appropriate methylol compounds by the method of Einhorn, e.g. 1-amino-3-chloroacetylaminomethylbenzene-6-sulfonic acid.

The acylation reactions with the fibre-reactive acylating agents are conveniently carried out using acid acceptors, such as sodium carbonate or sodium hydroxide, and under such conditions that replaceable halogen atoms, unsaturated bonds or the like still remain in the reactive radical, that is to say, for example, in organic solvents or at relatively low temperatures in aqueous medium.

In the process of this invention it is especially preferred to use the following dyes, by themselves or in every possible combination:

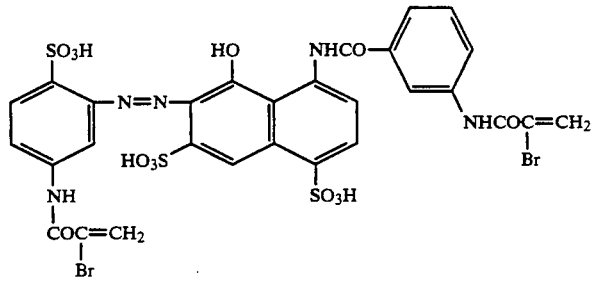

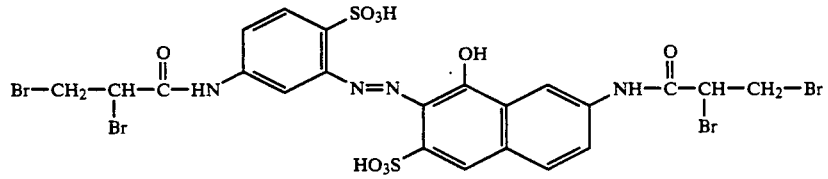

-continued
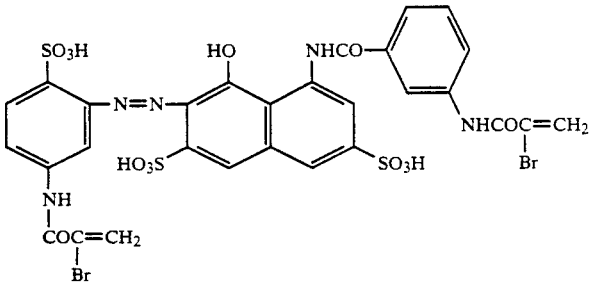
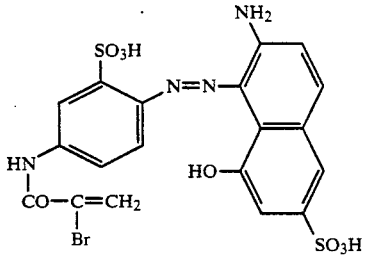
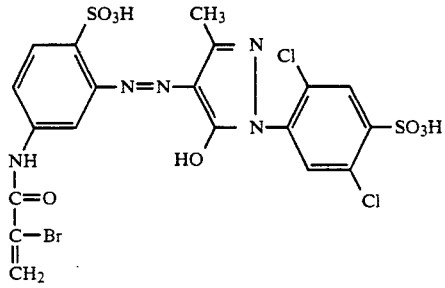
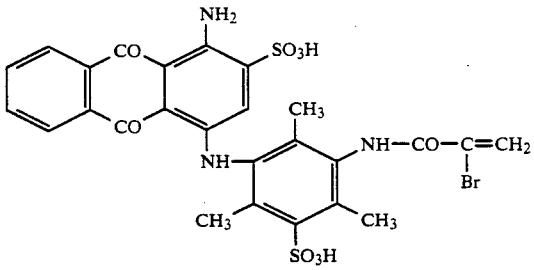
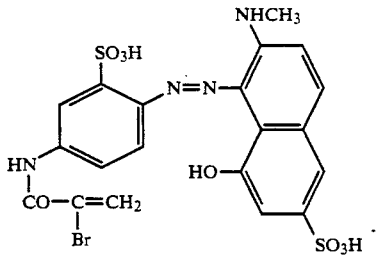
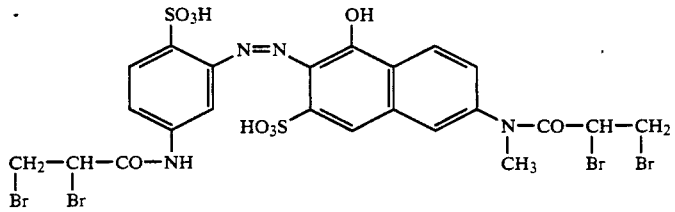
1:2 chromium mixed complex of dyes of the fomulae

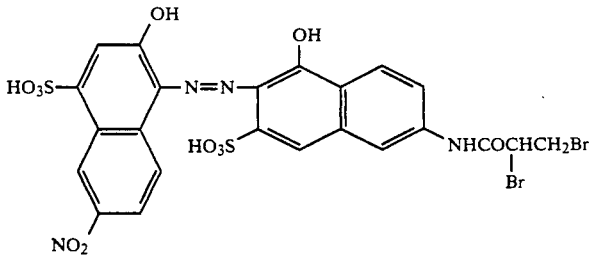

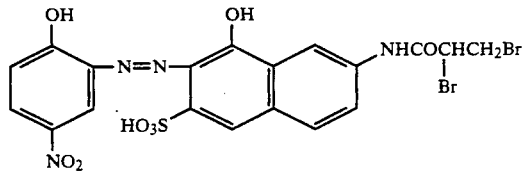

as well as

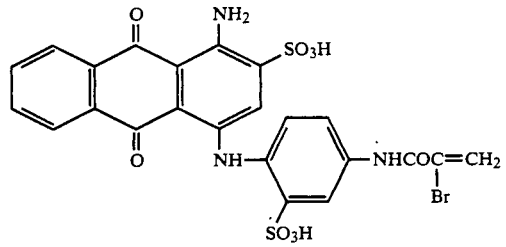

Exemplary of suitable acyl halides of formula (5) are:

α,β-dibromopropionyl chloride,
α,β-dichloropropionyl chloride,
α-bromoacryloyl chloride,
α-chloroacryloyl chloride,
and, in some cases, also halogen acid anhyrides such as α,β-dichloropropionic acid anhydride, which react in like manner.

After the process of this invention, dyeing or printing is carried out in aqueous medium. The procedure is such that the reactive dyes of formula (1) are applied in the temperature range from 15° to 100° C., preferably from 20° to 80° C., and fixed on the fibre material by steam, in the presence of alkali.

The process of this invention is used to produce dyeings and prints on blends of cellulosic fibre materials and silk. Suitable cellulosic fibre materials are, typically, natural cellulose fibres sauch as cotton, linen and hemp, as well as viscose staple and regenerated cellulose. Mixtures of different cellulosic fibres are also suitable, for example cotton and linen or cotton and viscose.

Suitable silk comprises not only natural or cultured silk (mulberry silk, Bombyx mori) but also the different wild silks, especially tussah silk, and also eria and fagara silk, nester silk, Senegal silk, muga milk, as well as shell silk and spun silk. The textile material can be in any form of presentation, such as fibres, yarn, wovens or knits.

In the process of this invention it is possible to dye or print the fibre blends in any ratio of the components, i.e. in all ratios of the cellulosic fibre component, preferably viscose, and of silk, for example blends containing 5 to 95% by weight of silk component. Preferred blends contain 5 to 70% by weight, preferably 5 to 40% by weight, of silk component. Blends containing 5 to 15% by weight of silk component are also of interest. Aside from cotton/silk and viscose/silk blends, suitable blends are also linen/cotton/silk and cotton/viscose/silk blends which contain the silk component in the indicated percentages by weight.

The process of this invention comprises impregnating or padding the fibre blends with a dye solution or suspension to a liquor pick-up of 50 to 120% by weight, preferably of 50 to 80% by weight. In addition to the dye component, the padding liquor may already contain the requisite amount of fixing alkali. Preferably the liquor will contain no fixing alkali. After application of the dye component, the material may be given an after-treatment, for example dried to a residual moisture content of ca. 5 to 20% by weight, preferably 5 to 15% by weight, then impregnated with a liquor containing the fixing alkali, after which the goods are subsequently fixed by steam.

Printing in the process of this invention is effected with an aqueous printing paste. The procedure comprises, for example, applying to the fibre blend a printing paste containing in addition to one or more of the indicated reactive dyes, at least one alkali such as $Na_2CO_3$, $NaHCO_3$ or $CH_3COONa$, in some cases a solubiliser such as urea, ε-caprolactam or dicyandiamide, a thickener, preferably an alginate such as sodium alginate, and emulsions or semi-emulsions, and, if appropriate, an oxidising agent such as the sodium salt of m-nitrobenzenesulfonic acid. The amount of fixing salt will depend, for example, on the nature and the number of the fibre-reactive radicals. An amount of 30 to 90 g, preferably 50 to 70 g, of fixing alkali per kg of printing paste has been found expedient. An amount of 0 to 200 g of urea per kg of printing paste is used as solubiliser. A 5% alginate thickener in an amount of ca. 500 g per kg of printing paste has proved useful. The amount of oxidising agent is in the range from 10 to 20 g per kg of printing paste. After printing, the goods are, if desired, dried and then steamed to fix the dyes on the fibre.

Preferred embodiments of the process of this invention comprise impregnating the fibre blends with a liquor which contains the dye solution or suspension and the fixing alkali and then steaming the dyed goods; or impregnating the fibre blends with a liquor which contains the dye solution or suspension, drying the goods, impregnating the dyed goods with a solution which contains the fixing alkali, and then steaming the goods.

A particularly preferred embodiment of the process of the invention comprises impregnating the fibre blends with a liquor which contains the dye solution or suspension to a liquor pick-up of 50 to 80% by weight, then drying the goods to a residual moisture content of 5 to 15% by weight in the temperature range from 70° to 150° C., thereafter impregnating the goods with a liquor which contains the fixing alkali to a liquor pick-up of 50 to 80% by weight, and subsequently steaming the goods.

The liquor ratio of the padding liquor with which the reactive dyes of formula (1) are applied to the fibre material is preferably from 1:0.5 bis 1:1.2, preferably from 1:0.5 to 1:0.8. The liquor is applied in the temperature range from 15° to 100° C., preferably from 20° to 80° C. and, most preferably, from 20° to 30° C.

Fixing alkalies which may suitable be used in the process of this invention are alkali metal hydroxides such as NaOH, KOH and LiOH, alkali metal carbonates such as sodium carbonate and potassium carbonate, and alkali metal hydrogen carbonates such as sodium hydrogen carbonate and potassium hydrogen carbonate, as well as trisodium phosphate and disodium phosphate, with or without neutral salts such as sodium chloride.

A particularly suitable fibre blend is a blend of viscose/silk.

If the fixing alkali is applied together with the dye, the pH of the liquor will be in the range from 8.5 to 14. If the fixing alkali is applied separately to the goods, the pH of the application liquor will be in the range from 8.5 to 14.

In the process of this invention, it has been found particularly advantageous to carry out the fixation by high temperature steaming in the temperature range from 100° to 220° C., preferably from 100° to 105° C. in saturated steam or 150° to 190° C. in a superheated steam atmosphere, at a pressure of 1 bar.

Fixation in saturated steam in the temperature range from 100° to 105° C. is especially preferred.

The steaming time is from 30 seconds to 20 minutes, preferably from 60 seconds to 3 minutes.

Depending on the desired depth of shade, the dyes are used in amounts of ca. 0.1 to 10%.

The dyes used in the process of this invention are either in the form of the free acid or, preferably, of salts thereof.

Suitable salts are, typically, the alkali metal salts, alkaline earth metal salts or ammonium salts or the salts of an organic amine. Exemplary of such salts are the sodium, lithium, potassium or ammonium salts or the salt of triethanolamine.

After fixation, the dyeings and prints are rinsed with cold and hot water, with or without the addition of an agent which acts as dispersant and promotes the diffusion of unfixed dye.

A preferred embodiment of the process of the invention comprises washing the dyed or printed goods in an aqueous wash liquor at a pH of 8.5 to 9 and at elevated temperature, preferably in the range from 70° to 85° C., in the presence orabsence of a nonionic detergent.

The dyeings and prints obtained with the reactive dyes used in the practice of this invention are distinguished by very good tone-in-tone shades on the goods. High degrees of fixation and a very good build-up are achieved, and the dyeings and prints have good all-round fastness properties, especially good lightfastness and very good wetfastness properties.

The dye liquors and print pastes can contain conventional ingredients such as the aqueous solutions of organic salts, for example of alkali metal chlorides or alkali metal sulfates, urea, thickeners such as alginate thickeners, water-soluble cellulose alkyl ethers, as well as dispersants, levelling agents and migration inhibitors, and also sodium m-nitrobenzenesulfonate and, for example, as further thickeners, methyl cellulose, starch ethers or emulsion thickeners, preferably an alginate such as sodium alginate, as well as wetting agents.

The invention is illustrated by the following Examples in which parts and percentages are by weight. The relationship between parts by weight and parts by volume is the same as that between the gram and the cubic centimetre. Amounts of dye refer to commercial product.

EXAMPLE 1

A blend fabric consisting of 94% by weight of viscose and 6% by weight of silk (Bombyx mori) is impregnated on the pad to a pick-up of 75% with a liquor of the following composition:

60 g/l of the dye of formula (100)

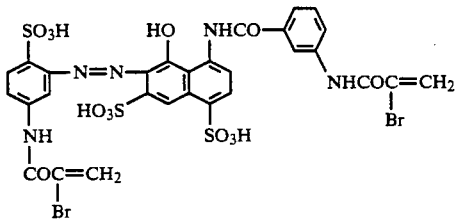

in the form of the free acid, 10 g/l of a migration inhibitor based on a polyacrylic acid derivative 2 g/l of sodium m-nitrobenzenesulfonate 2 g/l of a wetting agent.

Padding is effected at a temperature of 25° C.

The blend is then dried for 40 seconds at 120° C. to a residual moisture content of ca. 5 to 15% by weight. The goods are then impregnated on the pad to a pick-up of 75% at 25° C. with a liquor of the following composition:

200 g/l of sodium chloride 15 ml/l of an aqueous solution of sodium hydroxide having a density of 1.331 at 15° C.

The goods are subsequently steamed in saturated steam for 60° C. seconds at 102° C., rinsed with cold and then with hot water, soaped at the boil for 5 minutes with a nonionic detergent composition, rinsed once more and dried. An excellent red tone-in-tone dyeing is obtained on the blend fabric.

EXAMPLES 2-6

The procedure of Example 1 is repeated, using in place of 60 g/l of the dye of formula (100) the following dyes in the indicated amounts. Level dyeings in the indicated shade are obtained, both types of fibre, viscose and silk, being dyed tone-in-tone.

EXAMPLE 2

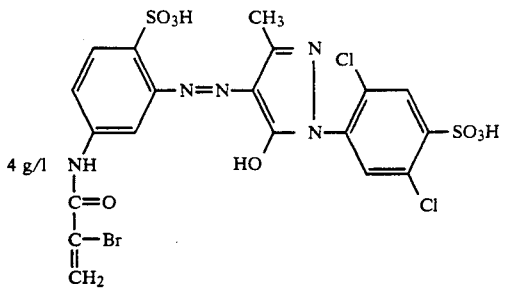

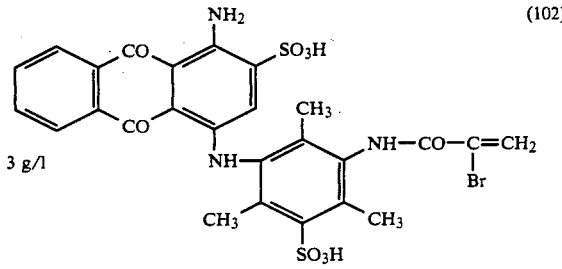

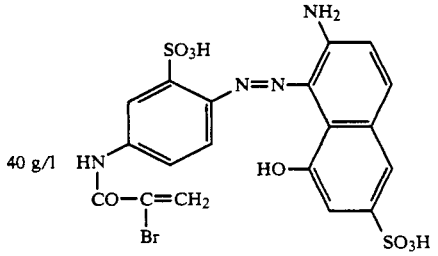

A level bordeaux dyeing is obtained.

EXAMPLE 3

1.5 g/l of the dye of formula (101)
1 g/l of the dye of formula

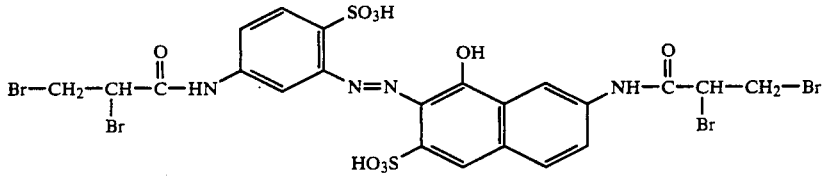

40 g/l of the dye of formula (102)

A level blue dyeing is obtained.

EXAMPLE 4

38 g/l of the dye of formula (101)
2 g/l of the dye of formula (104)
23 g/l of the dye of formula (102)

A level green dyeing is obtained.

EXAMPLE 5

28 g/l of the dye of formula (101)
18 g/l of the dye of formula (104)
6 g/l of the dye of formula (102)
6 g/l of the dye of formula

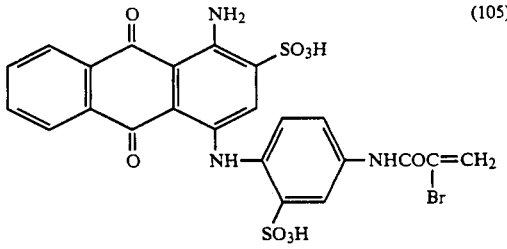

A level brown dyeing is obtained.

EXAMPLE 6

7.5 g/l of the dye of formula (101)
11 g/l of the dye of formula (104)
10 g/l of the dye of formula (102)
10 g/l of the dye of formula (105)

A level grey deing is obtained.

EXAMPLE 7

A blend fabric consisting of 50% by weight of viscose and 50% by weight of silk (Bombxy mori) is impregnated on the pad to a pick-up of 75% with a liquor of the following composition:

1 g/l of the dye of formula

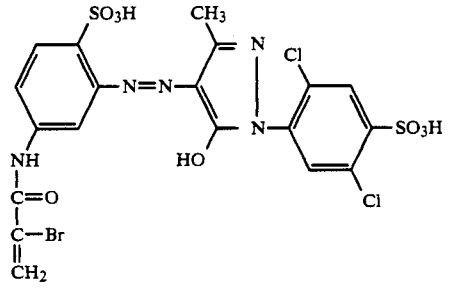

in the form of the free acid,
1 g/l of the dye of formula

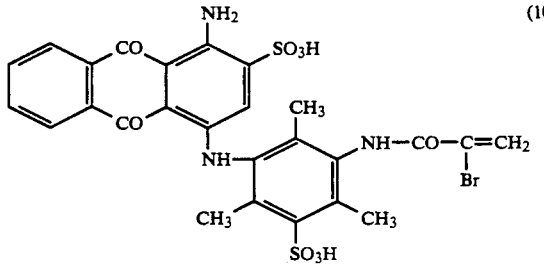

in the form of the free acid,
40 g/l of the dye of formula (100)

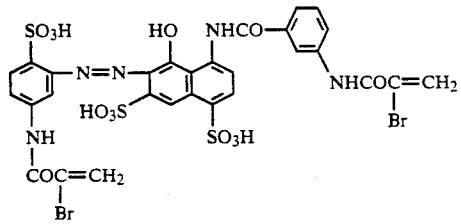

in the form of the free acid, 10 g/l of a migration inhibitor based on a polyacrylic acid derivative, 2 g/l of the sodium salt of m-nitrobenzenesulfonic acid and 2 g/l of a wetting agent.

Padding is effected at a temperature of 25° C.

The blend is then dried for 40 seconds at 120° C. to a residual moisture content of ca. 5 to 15% by weight. The goods are then impregnated on the pad to a pick-up of 75% at 25° C. with a liquor of the following composition:

200 g/l of sodium chloride 15 ml/l of an aqueous solution of sodium hydroxide having a density of 1.331 at 15° C.

The goods are subsequently steamed in saturated steam for 60 seconds at 102° C., rinsed with cold and then with hot water, soaped at the boil for 5 minutes with a nonionic detergent composition rinsed once more and dried. An excellent red tone-in-tone dyeing is obtained on the blend fabric.

EXAMPLES 8-10

The procedure of Example 7 is repeated, using in place of the dyes of formulae (100), (101) and (102) the following dyes in the indicated amounts. Level dyeings in the indicated shade are obtained, both types of fibre, viscose and silk, being dyed tone-in-tone.

EXAMPLE 8

1.5 g/l of the dye of formula (101)
1.2 g/l of the dye of formula (104)
40 g/l of the dye of formula (102)

A level blue dyeing is obtained.

EXAMPLE 9

38 g/l of the dye of formula (101)
2 g/l of the dye of formula (104)
23 g/l of the dye of formula (102)

A level green dyeing is obtained.

EXAMPLE 10

7.5 g/l of the dye of formula (101)
11 g/l of the dye of formula (104)
10 g/l of the dye of formula (102)
10 g/l of the dye of formula (105)

A level grey dyeing is obtained.

EXAMPLE 11

A blend fabric consisting of 53% by weight of viscose, 12% by weight of silk and 35% by weight of cotton is impregnated on the pad to a pick-up of 75% with a liquor of the following composition:

60 g/l of the dye of formula (100)

10 g/l of a migration inhibitor based on a polyacrylic acid derivative and 0.5 g/l of a wetting agent.

Padding is effected at a temperature of 25° C.

The blend is then dried for 40 seconds at 120° C. to a residual moisture content of 15% by weight. The goods are then impregnated on the pad to a pick-up of 75% at 25° C. with a liquor of the following composition:

200 g/l of sodium chloride 15 ml/l of an aqueous solution of sodium hydroxide having a density of 1.331 at 15° C.

The goods are subsequently steamed in saturated steam for 60 seconds at 100°-102° C., rinsed with cold and then with hot water, soaped at the boil with a nonionic detergent composition, rinsed once more and dried. An excellent red tone-in-tone dyeing is obtained on the blend.

EXAMPLES 12 and 13

The procedure of Example 11 is repeated, using in place of the dye of formula (100) the following dyes in the indicated amounts and, as blend fabric, a blend consisting of 53% by weight of viscose, 12% by weight of silk, 30% by weight of cotton and 5% by weight of linen. Dyeings in the indicated shades are obtained, all types of fibre (cotton, linen, viscose and silk) being dyed tone-in-tone.

EXAMPLE 12

40 g/l of the dye of formula (101)

A level yellow dyeing is obtained.

EXAMPLE 13

50 g/l of the dye of formula (106)

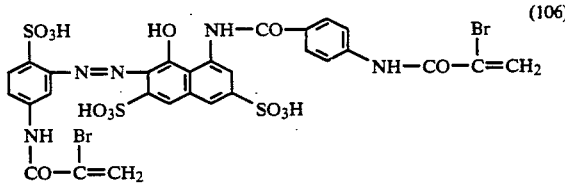

A level red dyeing is obtained.

EXAMPLE 14

A blend fabric consisting of 88% by weight of viscose and 12% by weight of silk is impregnated on the pad to a pick-up of 75% with a liquor of the following composition:

50 g/l of the dye of formula (103)

10 g/l of a migration inhibitor based on a polyacrylic acid derivative 0.5 g/l of a wetting agent 12 ml/l of an aqueous solution of sodium hydroxide having a density of 1.331 at 15° and 20 g/l of calcined $Na_2CO_3$.

Padding is effected at a temperature of 25° C.

The goods are subsequently steamed in saturated steam for 60 seconds at 100°-102° C., rinsed with cold and then with hot water, soaped at the boil with a non-ionic detergent composition, rinsed once more and dried. An excellent red tone-in-tone dyeing is obtained on the blend fabric.

EXAMPLES 15 and 16

The procedure of Example 14 is repeated, using in place of the dye of formula (103) the following dyes in the indicated amounts and, as blend fabric, a blend consisting of 53% by weight of viscose, 12% by weight of silk, and 35% by weight of cotton. Dyeings in the indicated shades are obtained, all types of fibre (cotton, viscose and silk) being dyed tone-in-tone.

EXAMPLE 15

50 g/l of the dye of formula (105)

A level blue dyeing is obtained.

EXAMPLE 16

50 g/l of the dye of formula (104)

A level red dyeing is obtained.

EXAMPLE 17

A blend fabric consisting of 88% by weight of viscose and 12% by weight of silk is printed to an add-on of 100 g/m$^2$ with a print paste of the following composition:

| | |
|---|---|
| 40 | g of the dye of formula (100) |
| 150 | g of urea |
| 275 | g of water |
| 500 | g of a 6% sodium alginate thickening |
| 10 | g of sodium m-nitrobenzenesulfonate |
| 5 | g of a nonionic antifoam and |
| 20 | g of $NaHCO_3$ |
| 1000 | g of print paste |

Stripes ca. 4 cm in width are printed on the blend fabric by flat screen printing. The prints are subsequently dried for 5 minutes at 100° C. and steamed in saturated steam for 20 minutes at 100°-102° C., rinsed thoroughly with cold water and then treated for 5 minutes at 50° C. with an auxiliary which has affinity for the dye and is based on a polyglycol ether and an aliphatic amine, so as to prevent staining of the non-printed areas by unfixed dye. This treatment is repeated in a fresh bath, but using 1 ml/l of a 25% aqueous solution of ammonia, for 5 minutes at 80° C. The goods are then rinsed with warm and with cold water and dried. A good yellow tone-in-tone print is obtained on the blend fabric.

EXAMPLES 18-21

The procedure of Example 17 is repeated, using in place of the dye of formula (100) the following dyes in the indicated amounts. Prints in the indicated shade are obtained, both types of fibre, viscose and silk, being printed tone-in-tone.

EXAMPLE 18

40 g of the dye of formula

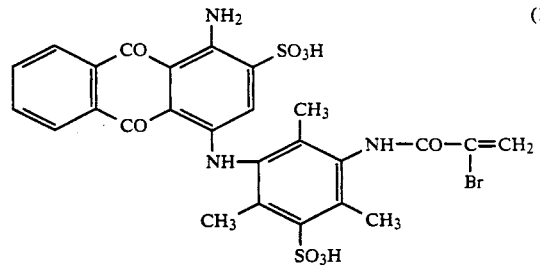

(107)

A blue print is obtained.

EXAMPLE 19

50 g of the dye of formula

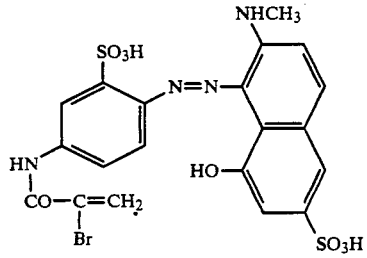

(108)

A red print is obtained.

EXAMPLE 20

40 g of the dye of formula

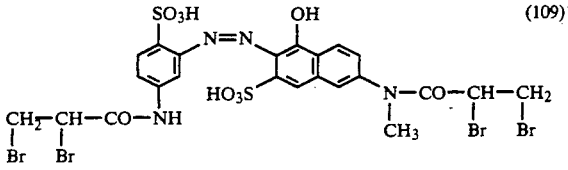

(109)

An orange print is obtained.

EXAMPLE 21

60 g of the 1:2 chromium mixed complex of the azo dyes of formulae

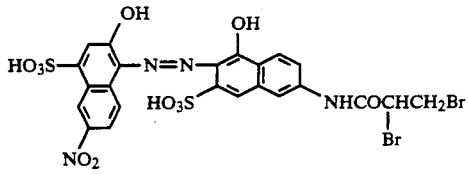

(110)

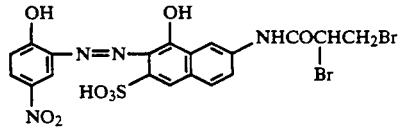

(111)

A black print is obtained.

What is claimed is:

1. A process for dyeing a blend of silk and cellulosic fibers which comprises:

(a) applying a reactive dye or mixture of reactive dyes to the blend by means of padding, said reactive dye having the formula $$D\left[\underset{\underset{R}{|}}{N}-CO-Y\right]_m, \quad (1)$$

wherein D is the radical of a sulfonated dye of the monoazo, polyazo, metal complex azo, anthraquinone, phthalocyanine, formazan, azomethine, dioxazine, phenazine, stilbene, triphenylmethane, xanthene, thioxanthone, nitroaryl, naphthoquinone, pyrenequinone or perylenetetracarbimide series, R is hydrogen or $C_1$-$C_4$alkyl which is unsubstituted or substituted by halogen, hydroxy, aminosulfonyl, cyano, alkoxy, alkoxycarbonyl, carboxy, sulfato or sulfo, Y is a radical $$-\underset{\underset{X}{|}}{CH}-CH_2-X \quad \text{or} \quad -\underset{\underset{X}{|}}{C}=CH_2,$$

m is 1 or 2 and X is chloro or bromo, (b) simultaneously or subsequently applying a fixing alkali to the blend, and (c) subsequently steaming the fiber material.

2. A process according to claim 1, wherein D is the radical of a mono- or disazo dye.

3. A process according to claim 1, wherein D is the radical of a copper complex azo dye.

4. A process according to claim 1, wherein D is the radical of a copper or nickel phthalocyanine, copper formazan complex or triphenyldioxazine dye.

5. A process according to claim 3, wherein D is the radical of a 1:1 copper complex azo dye of the benzene or naphthalene series and the copper atom is attached in each case to a metallisable group in ortho-position to the azo bond.

6. A process according to claim 2, wherein the reactive dye is of the formula $$[D_1-N=N-K]\left[\underset{\underset{R}{|}}{N}-CO-Y\right]_{1-2}, \quad (2)$$

wherein $D_1$ is the radical of a diazo component of the benzene or naphthalene series, K is the radical of a coupling component of the benzene, naphthalene or heterocyclic series, R is hydrogen or unsubstituted $C_1$-$C_4$alkyl, wherein the $$-\left[\underset{\underset{R}{|}}{N}-CO-Y\right]$$

group or groups are attached to either or both of the diazo component and the coupling component.

7. A process according to claim 1, wherein R is hydrogen or methyl.

8. A process according to claim 1, wherein the reactive dye of formula (1) contains two radicals of formula $$-\underset{\underset{R}{|}}{N}-CO-Y. \quad (3)$$

9. A process according to claim 1, wherein Y is a $\alpha,\beta$-dibromoethyl or $\alpha$-bromovinyl radical.

10. A process according to claim 1, wherein the reactive dyes are applied from a padding liquor at a liquor ratio of 1:0.5 to 1:1.2.

11. A process according to claim 1 wherein the blend is a cotton/silk, cotton/viscose/silk, cotton/viscose/linen/silk or viscose/silk blend.

12. A process according to claim 1, which comprises applying the reactive dye from a padding liquor, drying the blend, subsequently impregnating the blend with a liquid containing the fixing alkali, and thereafter steaming the goods.

13. A process according to claim 1, which comprises applying the reactive dye and the fixing alkali simultaneously from a padding liquor, and then steaming the blend.

14. A process according to claim 1, which comprises steaming the blend in the temperature range from 100° to 220° C.

15. A process according to claim 1, which comprises steaming the blend with saturated steam in the temperature range from 100° to 105° C.

16. A process according to claim 1, wherein the fixing alkali is an alkali metal hydroxide, an alkali metal carbonate, an alkali metal hydrogen carbonate or an alkali metal phosphate.

17. A process according to claim 16, wherein the fixing alkali is used together with a neutral salt.

18. A process according to claim 10, wherein the reactive dyes are applied from a padding liquor at a liquor ratio of 1:0.5 to 1.0.8.

19. A process according to claim 11, wherein the blend is a viscose/silk blend.

20. A process according to claim 14, which comprises steaming the blend in the temperature range from 100° to 105° C.

21. A process according to claim 17, wherein the fixing alkali is used together with sodium chloride.

* * * * *